US008359772B2

(12) United States Patent
La Rochelle

(10) Patent No.: US 8,359,772 B2
(45) Date of Patent: Jan. 29, 2013

(54) SAFETY FOOTWEAR

(76) Inventor: Simon La Rochelle, Granby (CA)

( * ) Notice: Subject to any disclaimer, the term of this patent is extended or adjusted under 35 U.S.C. 154(b) by 395 days.

(21) Appl. No.: 12/582,007

(22) Filed: Oct. 20, 2009

(65) Prior Publication Data

US 2010/0095549 A1 Apr. 22, 2010

Related U.S. Application Data

(60) Provisional application No. 61/106,651, filed on Oct. 20, 2008.

(51) Int. Cl.
*A43C 13/14* (2006.01)

(52) U.S. Cl. ..... 36/77 R; 36/113; 12/146 D; 12/142 K

(58) Field of Classification Search ..... 36/77 R, 36/77 M, 72 R, 113; 12/146 D, 142 K
See application file for complete search history.

(56) References Cited

U.S. PATENT DOCUMENTS

| | | | | | |
|---|---|---|---|---|---|
| 1,115,045 | A | * | 10/1914 | Werkheiser | 36/77 R |
| 1,221,985 | A | * | 4/1917 | Golden | 36/128 |
| 2,334,474 | A | * | 11/1943 | Chertok | 36/72 R |
| 2,342,815 | A | * | 2/1944 | Miner | 36/17 R |
| 2,426,211 | A | * | 8/1947 | Heckman | 36/4 |
| 2,747,303 | A | * | 5/1956 | Abrahams | 36/72 R |
| 3,191,321 | A | * | 6/1965 | Brutting | 36/133 |
| 3,716,932 | A | * | 2/1973 | Pakulak | 36/72 R |
| 4,314,707 | A | | 2/1982 | Welch | |
| 4,811,501 | A | | 3/1989 | Okayasu | |
| 4,924,606 | A | * | 5/1990 | Montgomery et al. | 36/31 |
| 4,995,174 | A | * | 2/1991 | Hong et al. | 36/72 R |
| 5,074,060 | A | * | 12/1991 | Brncick et al. | 36/77 R |
| 5,410,821 | A | * | 5/1995 | Hilgendorf | 36/100 |
| 2003/0121181 | A1 | * | 7/2003 | Chang | 36/45 |
| 2005/0268492 | A1 | * | 12/2005 | Fuerst | 36/77 R |
| 2006/0101669 | A1 | * | 5/2006 | Santos | 36/77 R |
| 2007/0068043 | A1 | * | 3/2007 | Clark et al. | 36/72 R |
| 2008/0052959 | A1 | * | 3/2008 | Hu | 36/42 |
| 2008/0163519 | A1 | * | 7/2008 | Sartor et al. | 36/77 M |
| 2009/0277041 | A1 | * | 11/2009 | Hubner | 36/12 |

FOREIGN PATENT DOCUMENTS

| | | |
|---|---|---|
| CA | 2091932 | 9/1994 |

OTHER PUBLICATIONS

Dr. Martens Construction, Doc Martens Boots, Docs, Dr Martens shoes, Let's show you what were made of, http://www.drmartens.com/Page.asp?NavID=62, Apr. 26, 2010.

* cited by examiner

*Primary Examiner* — Marie Patterson
(74) *Attorney, Agent, or Firm* — Norton Rose Canada LLP

(57) ABSTRACT

An item of footwear comprises an upper adapted to receive a foot of the wearer. A sole is secured to a bottom surface of the upper. A shell is positioned on a front-end portion of the upper so as to cover the toe region of the upper. The shell has an extension projecting below a junction between the upper and the sole to cover at least the junction in the toe region of the item of footwear.

22 Claims, 6 Drawing Sheets

PRIOR ART

SAFETY FOOTWEAR

CROSS-REFERENCE TO RELATED APPLICATION

The present application claims priority on U.S. Provisional Application Ser. No. 61/106,651, filed Oct. 20, 2008.

FIELD OF THE APPLICATION

The present application relates to footwear and, more specifically, to safety footwear of the type used in construction.

BACKGROUND OF THE ART

Safety footwear is often required on construction sites. A primary function of safety footwear, such as safety boots or shoes, is to protect the foot against impacts. Accordingly, some items of footwear include a toe-cap (e.g., steel toe or composite toe). The toe-cap defines a volume accommodating the toes of the wearer in the item of footwear so as to protect the toes against the impact from objects falling against the footwear. In most safety footwear, the toe-cap is within the upper and is therefore under the leather or synthetic material forming the exposed surface of the upper. As the material of the upper is above that of the toe-caps, the material of the upper often rips or is damaged over time as a result of abrasion and impact, thereby exposing the toe-cap material. As they are even used as "hammers" to kick objects, safety boots with toe-caps often wear out prematurely in the toe region.

The premature wearing-out of the leather in the toe region, accentuated by the presence of toe-caps, resulted in shoe manufacturers adding a protective shell over the leather in the toe region. Such a protective shell, commonly referred to as bumper toe, is made of a resistant compound (e.g., polyurethane). By protecting the material of the upper where the upper would normally break and tear, protective shells enhance the durability of the item of footwear.

Some bumper toes are cemented to the uppers prior to the soling process and a portion of such bumper toes is folded and secured under the edge of the last. Some bumper toes are molded during the injection of a midsole in a direct-attach construction. None of these constructions have an extension below the edge of the last.

Therefore, there remains a weakness at the junction between the upper and sole as well as between the midsole and outsole, in the front-end region of the item of footwear. The front-end region is subject to abrasion and/or intense shocks. The weakness is particularly notable in footwear with a direct-attach construction, as this type of assembly accentuates the separation of the different parts of sole and of the sole from upper. Moreover, the use of a low density midsole and the addition of a puncture resistant plate (e.g., steel plate) may emphasize this problem.

Referring to FIG. 1 of the prior art, a pair of safety boots in accordance with the prior art is illustrated. Namely, a regular safety boot is illustrated at 1 whereas a safety boot with protective shell is illustrated at 2. In the safety boots 1 and 2, the upper is illustrated at 3. On the safety boot 1, a toe-cap 4 is exposed through a rupture in leather. The safety boot 2 is similar in construction to the safety boot 1, but features a protective shell 4', i.e., bumper toe. The bumper toe 4', typically made of a sturdy material such as high-density plastic, is positioned on the outer surface of the upper 3 in order to protect the material of the upper from abrasion and shocks.

The boots 1 and 2 include a midsole 5, an outsole 6, with a joint 7 between the midsole 5 and the outsole 6. The joint 7 is typically trimmed so as to provide a smooth surface finish for the combination of the midsole 5 and the outsole 6.

There is illustrated by reference numeral 8 in FIG. 1 of the prior art the junction between the upper 3 and the midsole 5. It is a common construction for boots to glue the upper 3 to the midsole 5, or to bond both the upper 3 and outsole 6 in a direct-attach process where the midsole 5 is injected. Accordingly, some prior art construction footwear has been known to split between the upper 3 and the midsole 5, and/or between midsole 5 and outsole 6, at the front-end of the boot. Low density (0.4 to 0.6 kg/m$^3$) injected midsoles are known to tear off quickly as a result of abrasion and impact on the front region of the sole. On the safety boot 2, it is seen that the separation of midsole 5 and outsole 6 creates an opening at 9. Moreover, the puncture resistant plate is seen at 9'. This is a very common problem, called delamination, that occurs even though the safety boot is made with a pre-assembled bumper toe (e.g., cemented bumper toe) or a shell molded during the direct-attach process.

SUMMARY OF THE APPLICATION

It is therefore an aim of the present disclosure to provide safety footwear addressing issues associated with the prior art.

It is a further aim of the present disclosure to provide a method for manufacturing such safety footwear.

Therefore, in accordance with the present application, there is provided an item of footwear comprising: an upper adapted to receive a foot of the wearer; a sole secured to a bottom surface of the upper; and a shell positioned on a front-end portion of the upper so as to cover the toe region of the upper, the shell having an extension projecting below a junction between the upper and the sole to cover at least the junction in the toe region of the sole.

Further in accordance with the present application, there is provided a method for assembling an item of footwear comprising: assembling an upper to a sole to form an item of footwear; positioning a shell on a toe region of the item of footwear such that the shell covers at least a junction between the upper and the sole; and securing the shell to the item of footwear; wherein assembling, positioning and securing are performed in any order.

DESCRIPTION OF THE PREFERRED EMBODIMENTS

Figure 1:
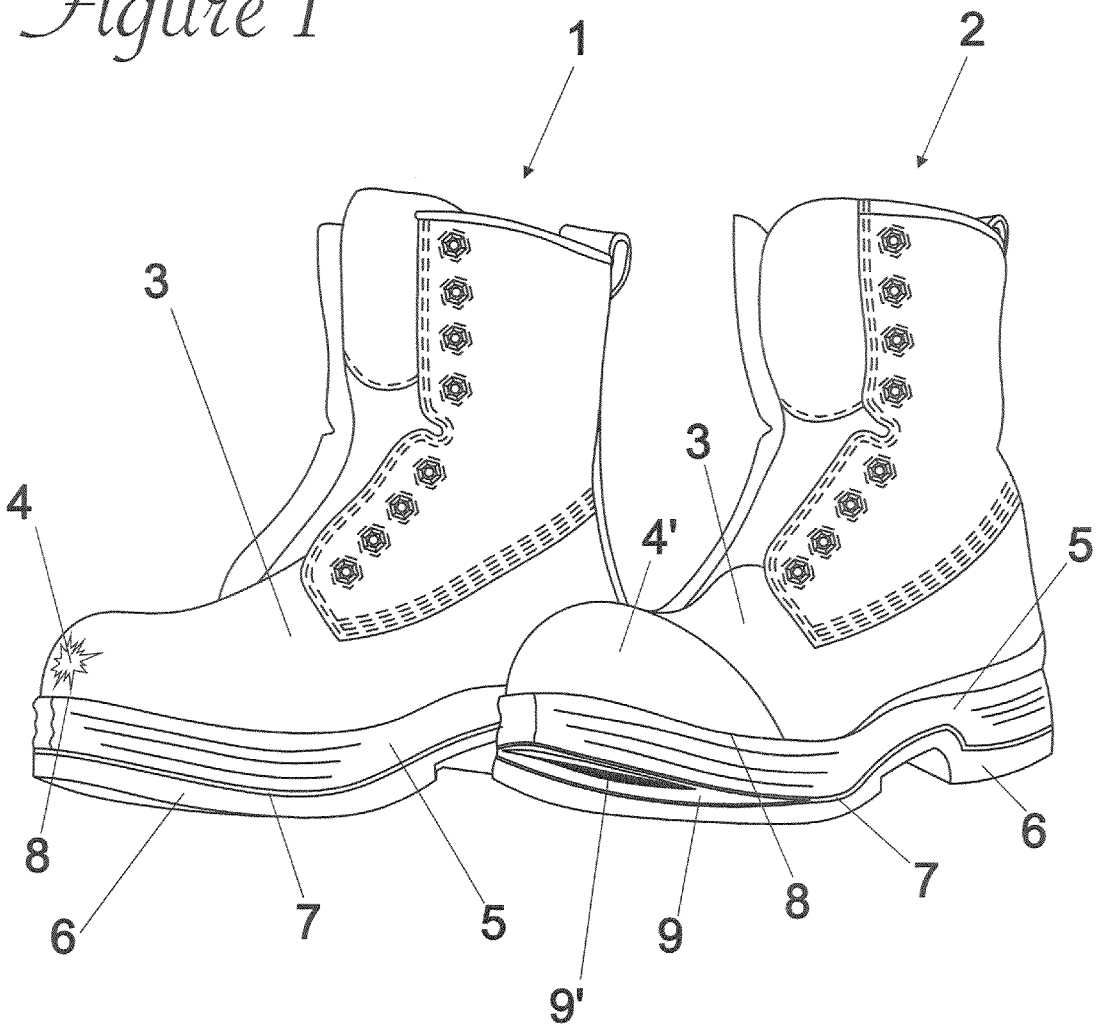
FIG. 1 is a perspective view of safety boots in accordance with the prior art.
Figure 2:
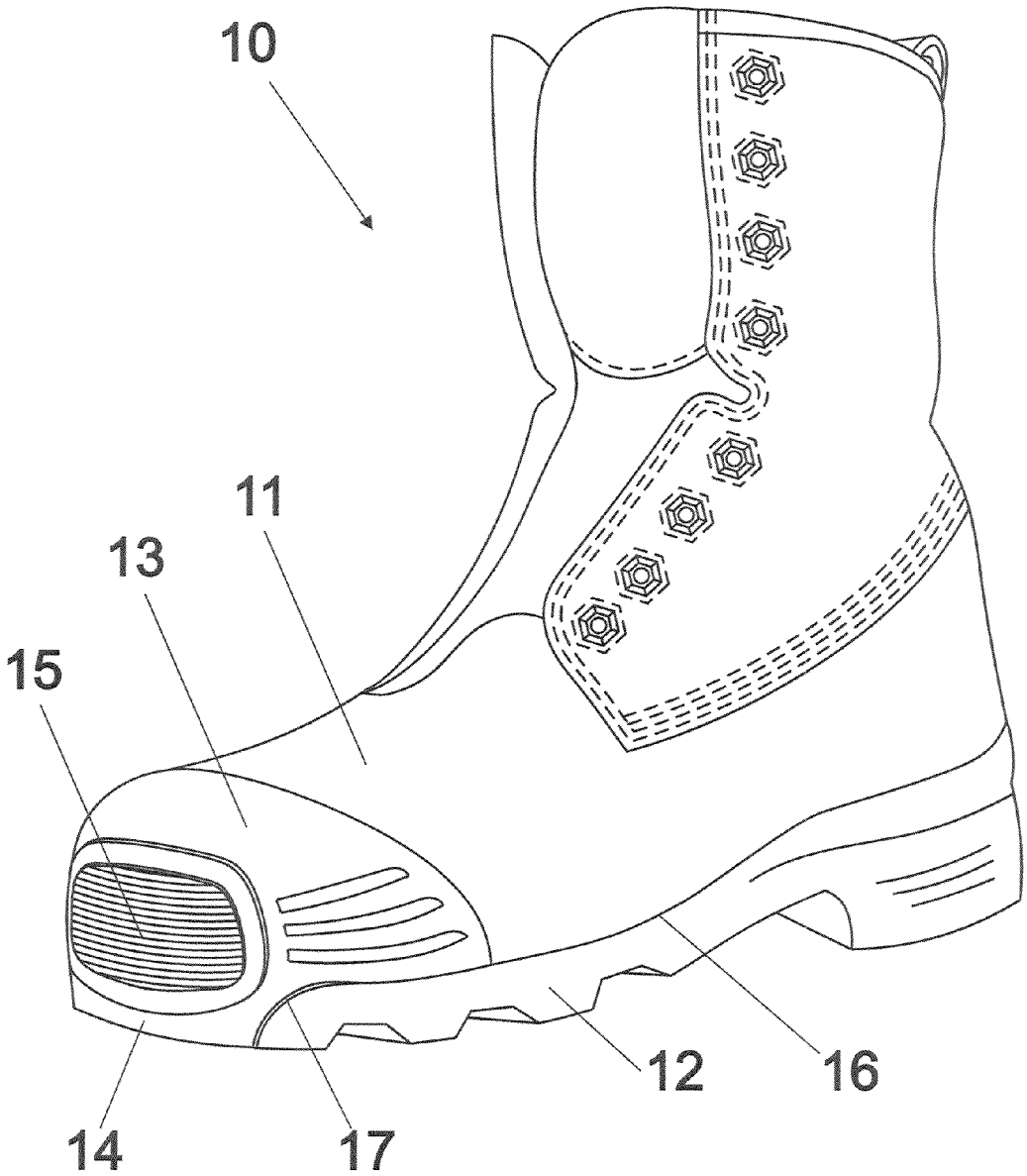
FIG. 2 is a perspective view of a safety boot in accordance with the present disclosure.

Referring to the drawings, and more particularly to FIG. 2, a safety boot in accordance with the present disclosure is shown at 10. It is pointed out that the item of footwear 10 is a boot, but could also be a shoe or any other type of footwear featuring a protective shell as will be described hereinafter.

The boot 10 of FIG. 2 is shown without laces for simplicity purposes. However, it is understood that the boot 10 comprises laces or any other suitable attachment means such as Velcro, elastics or the like, during normal use.

The boot 10 has an upper 11 that receives the foot of the wearer. A sole 12 is the interface between the upper 11 and the ground. Although not shown, a toe-cap may be provided within the material of the upper 11, or above the material of the upper 11.

A protective shell 13, also known as bumper toe, is provided at the front end of the upper 11 so as to form a shell that will cover the upper material, and provide abrasion resistance and impact resistance to the upper material at the front-end of the boot 10. The protective shell 13 is made of a sturdy material and is preferably an integral piece (e.g., molded, cast). As shown in FIG. 2, the protective shell 13 has a bottom extension 14 that projects below the joint between the upper 11 and the sole 12, and laterally to the front sides of the boot 10. As is shown in FIG. 2, the bottom extension 14 of the protective shell 13 may have a bottom edge flush with an undersurface of the sole 12, so as to shield any joint in the front-end region of the boot 10.

The protective shell 13 optionally supports a head plate 15. The head plate 15 provides additional functions to the boot 10. For instance, in FIG. 2, the head plate 15 is illustrated as having a plurality of ribs. Therefore, the head plate 15 defines a gripping surface, so as to provide traction to the wearer of the boot 10, for instance when the wearer is crouching or kneeling. This function is advantageous when the boot 10 is used in roofing work or the like. With a head plate 15 positioned in the front of the protective shell 13, as shown on FIG. 3, the wearer of the boot 10 may push or drag objects using the toe end of the boot 10. Although ribs are illustrated in FIG. 2, the head plate 15 may form a gripping surface without ribs, for instance by being made from Materials having high friction coefficients.

Figure 3:
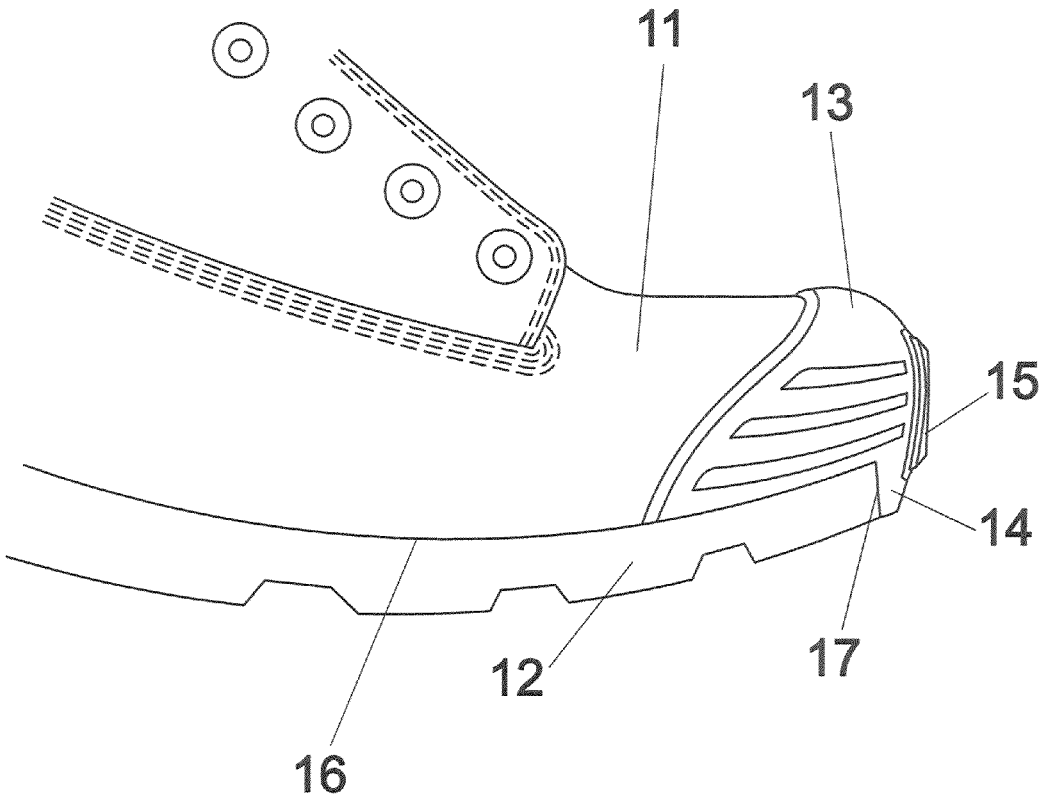
FIG. 3 is a right-side elevation view of the safety boot of FIG. 2.
Figure 6:
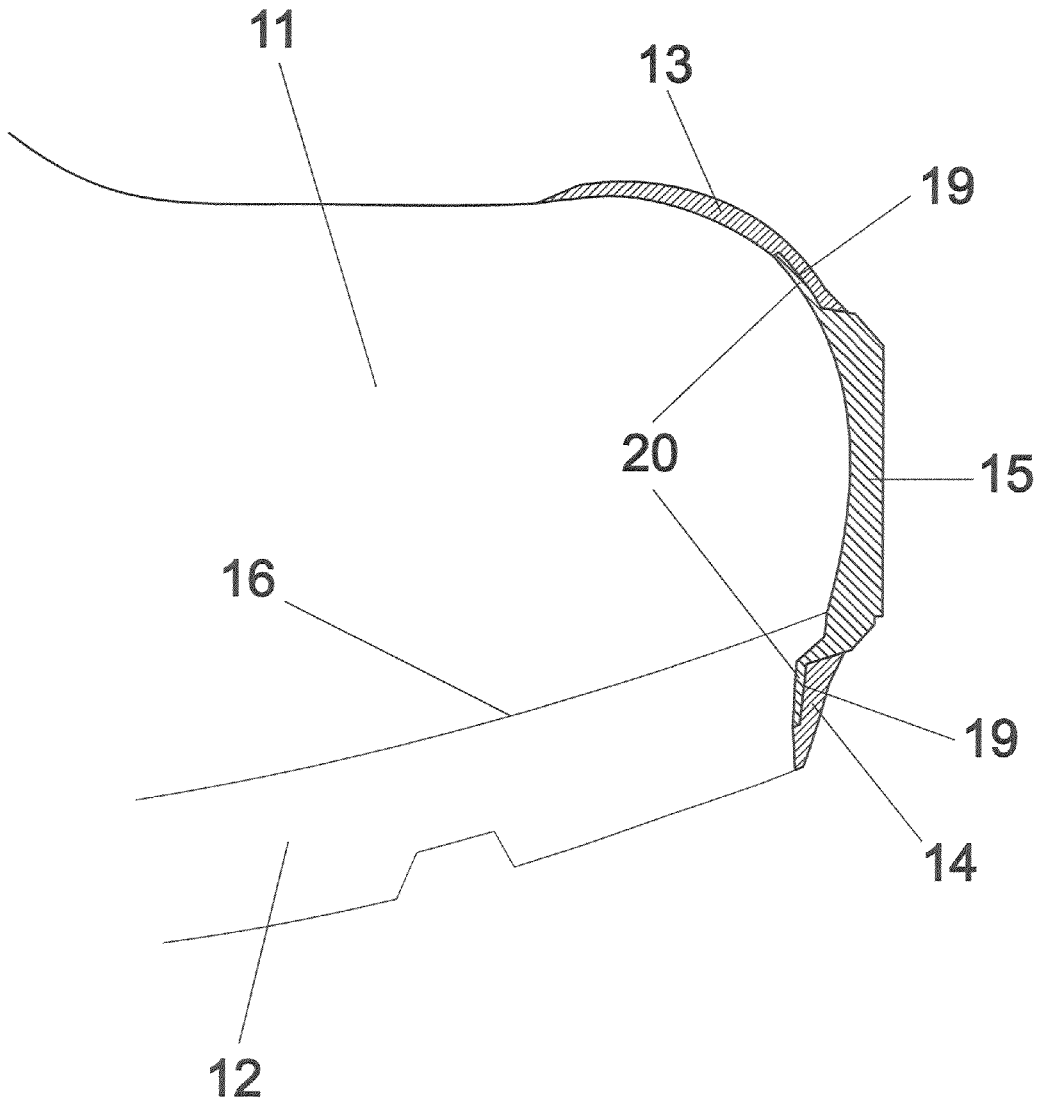
FIG. 6 is a sectional view of a protective shell as used on the safety boot of FIG. 2.

Moreover, the head plate 15 may also be used as an impact zone for shock absorption when the wearer of the boot 10 uses the protective shell 13 as a tool to hammer/kick some items such as nails, wood trims or the like. With the bottom extension 14 extending below the joint or junction 16 between the upper 11 and the sole 12, the boot 10 may be used for this function without risking a separation of the various toe parts of the boot 10. The junction edge between the protective shell 13 and the sole 12, as illustrated at 17 in FIG. 3, is away from the toe end and extends to the sides of the boot 10. Therefore, no sole joint or upper/sole joint is exposed at the toe end of the boot 10. In this embodiment, the material of the head plate 15 is selected so as to provide shock absorption, adherence, abrasion resistance, while being resilient. As shown in FIG. 6, the head plate 15 may be the foremost part of the boot 10, to ensure the proper contact of the protective shell 13 with the nail or like fastener.

Figure 4:
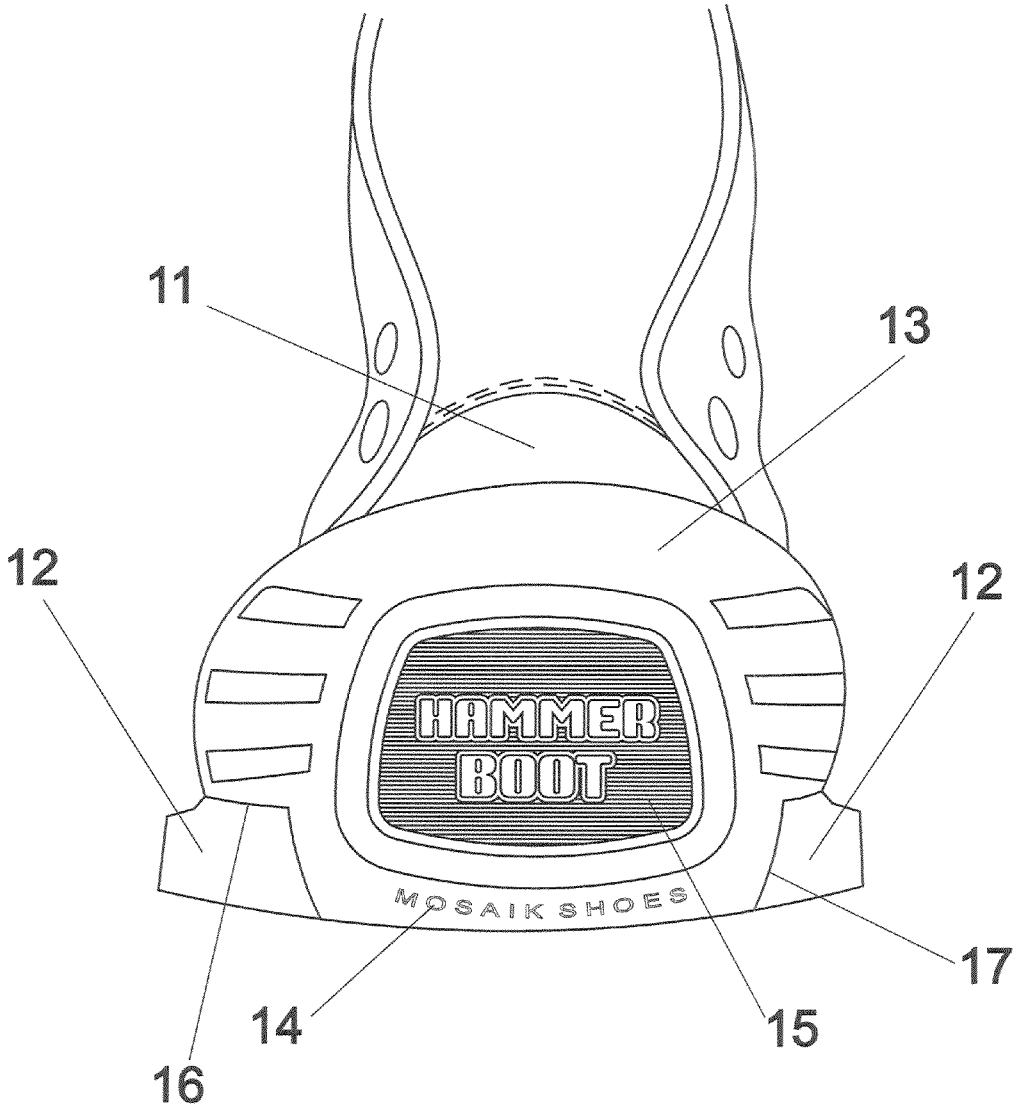
FIG. 4 is a front elevation view of the safety boot of FIG. 2, with a head plate thereon.

Referring to FIG. 4, it is observed that ornamental features may be provided on the protective shell 13. More specifically, the bottom extension 14 features a trademark of the boot and the head plate 15 features another trademark. It is considered to provide a generic model of boot 10 and enable distributors to change the head plates 15 so as to allow them to use their own trademarks for the boot 10. Moreover, it is considered to provide the head plates 15 in different shapes, and not solely in a generally rectangular shape (as shown in the figures). There are also provided on the protective shell 13 plural ribs (in sets of three on opposed sides of the head plate 15) to add ornamental features to the protective shell 13. It is pointed out that the ornamental features may be different, according to designer ideas.

Figure 5:
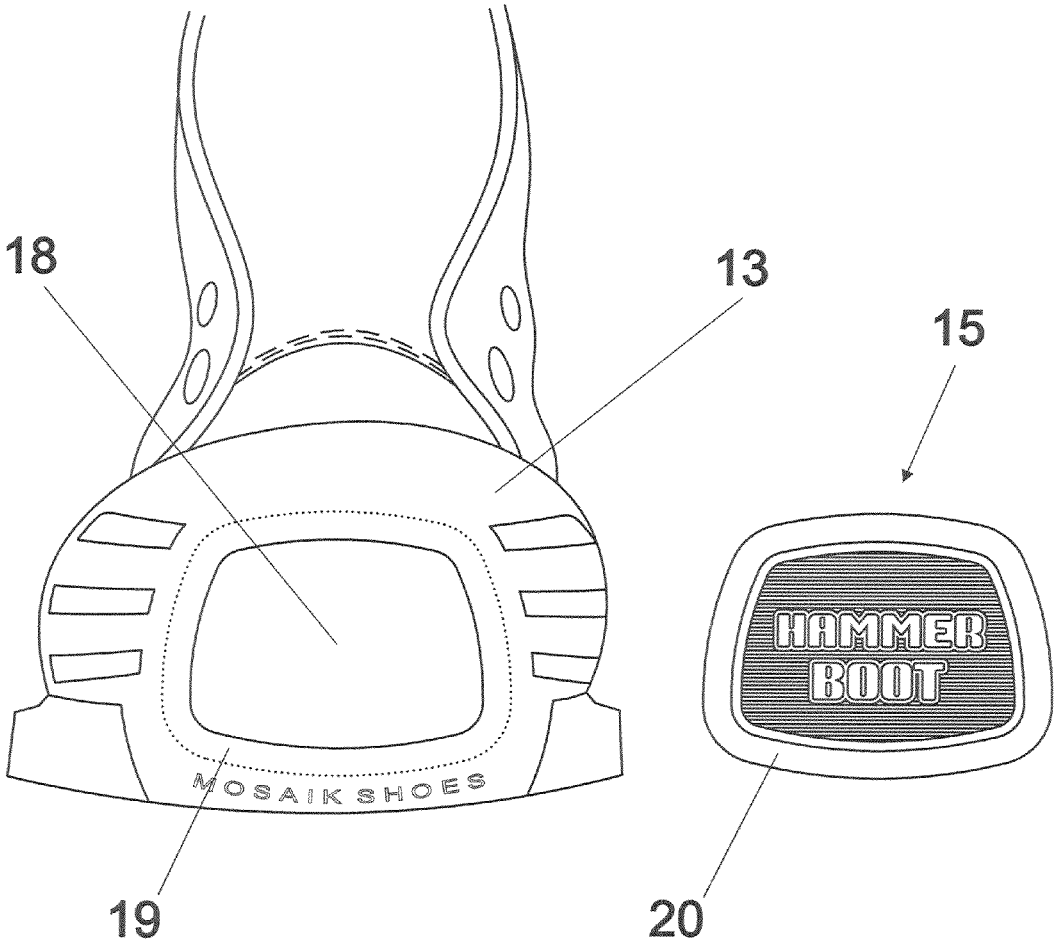
FIG. 5 is a front elevation view of the safety boot of FIG. 4, with the head plate removed.

Referring to FIGS. 5 and 6, a preferred inter-connection between the contact plate 15 and a body of the protective shell 13 is illustrated. In this embodiment, the protective shell 13 defines an opening 18 in which the head plate 15 is accommodated. An abutment flange 19 is provided in the periphery of the opening 18 in the protective shell 13, and the head plate 15 features a shoulder 20 abutting against the flange 19. Various techniques may be used in order to secure the contact plate 15 to a remainder of the protective shell 13, such as stitching, cementing, welding, using other adhesives and the like. It is also observed from FIG. 6 that projection of the sole is matingly received in a corresponding cavity in the shell 13.

The protective shell 13 may be used on an item of footwear that has a toe-cap under the upper, or may also replace the toe-cap altogether. In such a case, the protective shell 13 must have a robust structure, made of steel or like metals, high-density polymers or composite materials. The protective shell 13 may also be used on regular footwear, as opposed to safety footwear, to increase abrasion and shock resistance of the toe region of the footwear, without necessarily providing the toe protection offered by standard toe-caps.

It is pointed out that the protective shell 13 may be an extension of the sole, or a part of the sole (i.e., midsole, outsole), folded or molded over the front-end region of upper, thereby encapsulating a head plate with the upper. In such a case, the protective shell 13 is integral with the sole.

In order to manufacture the safety boot 10, processes are now described.

The protective shell 13 is cast or molded in suitable materials. Materials that offer high abrasion resistance and absorption qualities as well as a suitable friction coefficient for adherence are preferred. For instance, thermoplastic polyurethane (TPU) is the material that is typically used, as well as conventional materials such as steel, aluminum, composites or the like in the event that the protective shell 13 is used to replace the toe-cap under the upper. As for the head plate 15, a synthetic rubber (SBR) may be used, amongst numerous other materials. A cement is then used to secure the contact plate 15 to a remainder of the protective shell 13, as illustrated in FIG. 6.

According to one process, the protective shell 13 is firstly adhered to the upper 11, by cementing, injection-molding or stitching, among numerous possibilities. The sole 12 is subsequently secured to the upper 11 in the manner shown in FIG. 2, for instance by direct-attach molding, by gluing, by stitching, or the like.

The sole 12 may be secured to the upper 11 as described above prior to the protective shell 13 being assembled thereto. In such a case, the sole 12 is shaped in the toe region as a function of the protective shell 13 that will be mated thereto afterwards. Finally, the sole 12 may be added to the boot 10 in different steps. A midsole may first be secured to the upper 11 and to the protective shell 13, with an outsole being molded directly to the midsole afterwards. In another embodiment, the midsole may first be molded to the upper 11 and to the protective shell 13, with an outsole being secured to the midsole afterwards. Other sequences are considered as well.

It is also considered to mold separately an outsole with an extension on the front, the extension having an opening where a head plate is secured. Then, when assembling the sole to upper, the extension of the outsole is folded over the front-end of the upper to form a protective shell with a head plate exposed in the protective shell.

It is also considered to position the upper 11 and shell 13 on a last, and to subsequently secure the sole 12 to the upper and shell assembly. In such a case, it is considered to have a bottom edge of the extension of the shell 13 extend by at least 5 mm below the last. The sole 12 may be molded to encapsulate the bottom portion of the shell 13, in which case the bottom portion of the shell 13 is encapsulated in the sole 12.

The final product is an item of footwear featuring a protective shell that protects the toe region of the sole and upper against abrasion and impacts.

The invention claimed is:

1. An item of footwear comprising:

an upper adapted to receive a foot of the wearer;

a sole secured to a bottom surface of the upper, the sole having a peripheral lateral surface and an undersurface; and a shell positioned on a front-end portion of the upper so as to cover the toe region of the upper, the shell made of at least one of a composite and a high-density polymer and having an extension projecting below a junction between the upper and the sole to cover at least the junction in the toe region of the item of footwear, a bottom edge of said shell covering part of the peripheral lateral surface of the sole and extending downwardly at most flush with the undersurface of the sole at the front-end portion of the upper, the shell being at least one of cemented and direct-attach molded to the peripheral lateral surface of the sole.

2. The item of footwear according to claim 1, further comprising a toe cap in the upper in the toe region thereof.

3. The item of footwear according to claim 1, wherein a bottom edge of the extension is flush with a bottom surface of the sole.

4. The item of footwear according to claim 1, wherein lateral edges of extension extends laterally to the front sides of the sole.

5. The item of footwear according to claim 1, further the shell has a gripping surface.

6. The item of footwear according to claim 5, wherein the gripping surface has a plurality of generally horizontal ribs.

7. The item of footwear according to claim 1, wherein a head plate is removably secured to the shell, the head plate having a texture or material different than that of the shell.

8. The item of footwear according to claim 7, wherein the head plate is the foremost portion of the item of footwear, whereby the head plate is used to hit objects.

9. The item of footwear according to claim 7, wherein the head plate has a peripheral shoulder engaging against a flange defining a corresponding opening in the shell.

10. The item of footwear according to claim 7, wherein the head plate is made of synthetic rubber and the shell is made of thermoplastic urethane.

11. The item of footwear according to claim 1, wherein the shell is made of at least one of a polymer, a metal, and a composite material.

12. The item of footwear according to claim 1, wherein the sole has a midsole, an outsole and a joint line therebetween, and the extension of the shell covers the joint line in the toe region of the item of footwear.

13. The item of footwear according to claim 1, wherein the sole, the portion of the sole and the shell are molded to at least the upper.

14. The item of footwear according to claim 13, wherein the shell and outsole are molded to the upper and midsole.

15. The item of footwear according to claim 13, further comprising a head plate removably secured to the shell, the head plate having a texture or material different than that of the shell and outsole.

16. A method for assembling an item of footwear comprising:

assembling an upper to a sole to form an item of footwear;

positioning a shell of at least one of a composite material and high-density polymer on a toe region of the item of footwear such that the shell covers at least a junction between the upper and the sole, a bottom edge of said shell covering part of the peripheral lateral surface of the sole and extending downwardly at most flush with the undersurface of the sole at the front-end portion of the upper; and securing the shell to the item of footwear by at least one of currently and direct-attach molding the shell to the peripheral lateral surface.

17. The method according to claim 16, wherein securing the shell to the item of footwear comprises one of cementing, injection-molding, and stitching the shell to the upper, and subsequently assembling the upper to the sole comprises one of cementing, injection-molding and stitching the sole to the upper.

18. The method according to claim 16, wherein assembling the upper to the sole comprises one of cementing, injection-molding and stitching the sole to the upper, and subsequently securing the shell to the item of footwear comprises one of cementing, injection-molding and stitching the shell to the upper.

19. An item of footwear comprising:

an upper adapted to receive a foot of the wearer;

a sole secured to a bottom surface of the upper;

a shell positioned on a front-end portion of the upper so as to cover the toe region of the upper, the shell having an extension projecting below a junction between the upper and the sole to cover at least the junction in the toe region of the item of footwear; and a head plate removably secured to the shell and exposed at an exterior surface of the item of footwear, the head plate having a material different than that of the shell.

20. The item of footwear according to claim 19, wherein the head plate is the foremost portion of the item of footwear, whereby the head plate is used to hit objects.

21. The item of footwear according to claim 19, wherein the head plate has a peripheral shoulder engaging against a flange defining a corresponding opening in the shell.

22. The item of footwear according to claim 19, wherein the head plate is made of synthetic rubber and the shell is made of thermoplastic urethane.

* * * * *